US010510308B2

(12) United States Patent
Mu

(10) Patent No.: US 10,510,308 B2
(45) Date of Patent: Dec. 17, 2019

(54) DISPLAY DEVICE WITH EACH COLUMN OF SUB-PIXEL UNITS BEING DRIVEN BY TWO DATA LINES AND DRIVING METHOD FOR DISPLAY DEVICE

(71) Applicants: BOE Technology Group Co., Ltd., Beijing (CN); Hefei Xinsheng Optoelectronics Technology Co., Ltd., Hefei (CN)

(72) Inventor: Suzhen Mu, Beijing (CN)

(73) Assignees: BOE Technology Group Co., Ltd., Beijing (CN); Hefei Xinsheng Optoelectronics Technology Co., Ltd., Hefei (CN)

( * ) Notice: Subject to any disclaimer, the term of this patent is extended or adjusted under 35 U.S.C. 154(b) by 306 days.

(21) Appl. No.: 15/298,841

(22) Filed: Oct. 20, 2016

(65) Prior Publication Data

US 2017/0263170 A1 Sep. 14, 2017

(30) Foreign Application Priority Data

Mar. 11, 2016 (CN) ..... 2016 1 0140950

(51) Int. Cl.
*G09G 3/36* (2006.01)

(52) U.S. Cl.
CPC ..... *G09G 3/3648* (2013.01); *G09G 3/3614* (2013.01); *G09G 2300/0426* (2013.01)

(58) Field of Classification Search
CPC ..... G09G 3/3648; G09G 3/3614; G09G 2300/0426
See application file for complete search history.

(56) References Cited

U.S. PATENT DOCUMENTS

2006/0164352 A1* 7/2006 Yoo ..... G02F 1/13624 345/87
2011/0134103 A1 6/2011 Nam et al.
(Continued)

FOREIGN PATENT DOCUMENTS

CN 102087842 A 6/2011
CN 104252854 A 12/2014
JP 2014109780 A 6/2014

OTHER PUBLICATIONS

May 2 2018—(CN) First Office Action Appn 201610140950.3 with English Translation.

*Primary Examiner* — Ryan A Lubit
(74) *Attorney, Agent, or Firm* — Banner & Witcoff, Ltd.

(57) ABSTRACT

An array substrate, a display device and a driving method thereof are disclosed. The array substrate includes gate lines, data lines intersecting with the gate lines, and sub-pixel units. Each sub-pixel unit includes a first sub-pixel and a second sub-pixel arranged with a same sequence; each row of sub-pixel units along a gate line direction are driven by two gate lines, and different rows of sub-pixel units are driven by different gate lines; each column of sub-pixel units along a data line direction are driven by two data lines; the first sub-pixel and the second sub-pixel in each sub-pixel unit are driven by different gate lines and different data lines, for the sub-pixels in each column, the sub-pixels in odd-numbered rows are driven by same one data line, and the sub-pixels in even-numbered rows are driven by same the other data line.

11 Claims, 6 Drawing Sheets

(56) References Cited

U.S. PATENT DOCUMENTS

| | | | | |
|---|---|---|---|---|
| 2012/0098871 | A1* | 4/2012 | Park | G09G 3/3607 345/690 |
| 2014/0002509 | A1* | 1/2014 | Kim | G09G 3/003 345/690 |
| 2014/0152938 | A1 | 6/2014 | Lee et al. | |
| 2015/0348481 | A1* | 12/2015 | Hong | G09G 3/2003 345/690 |
| 2015/0380435 | A1* | 12/2015 | Li | G09G 3/3614 349/43 |
| 2016/0018693 | A1 | 1/2016 | Um et al. | |
| 2016/0203776 | A1* | 7/2016 | Choo | G09G 3/3607 345/694 |
| 2016/0314736 | A1* | 10/2016 | Sang | G09G 3/3607 |

* cited by examiner

DISPLAY DEVICE WITH EACH COLUMN OF SUB-PIXEL UNITS BEING DRIVEN BY TWO DATA LINES AND DRIVING METHOD FOR DISPLAY DEVICE

This application claims priority to and the benefit of Chinese Patent Application No. 201610140950.3 filed on Mar. 11, 2016, which application is incorporated herein in its entirety.

TECHNICAL FIELD

The present disclosure relates to an array substrate, a display device and a driving method thereof.

BACKGROUND

Because of low power consumption property, liquid crystal displays (LCDs) have become very popular and suitable for all kinds of electronic devices. The main principle of LCD is to control the light transmission properties of liquid crystal through an electrical field so as to display images.

A liquid crystal display comprises an array substrate, a color filter substrate, and a liquid crystal layer disposed therebetween. As illustrated in FIG. 1, the array substrate generally comprises a plurality of gate lines (gate lines G1-G4) and a plurality of data lines (data lines D1-D8). A sub-pixel region is defined by a gate line and a data line that intersect with each other, a thin film transistor 10 and a pixel electrode 11 are configured in each sub-pixel region, in this way, a sub-pixel is obtained. The thin film transistor 10 comprises a gate electrode G, a source electrode S and a drain electrode D; the gate electrode is electrically connected to the gate line, the source electrode is electrically connected to the data line, and the drain electrode is electrically connected to the pixel electrode. Taking vertical electric field type liquid crystal display as an example, a common electrode is configured on the color filter substrate, an electrical field is generated when applying voltages to the pixel electrode and the common electrode. The magnitude of the electrical field generated between the pixel electrode and the common electrode determines the rotation degree of the liquid crystal molecules. Therefore, the rotation degrees of the liquid crystal molecules can be changed through adjusting the magnitude of the electrical field between the pixel electrode and the common electrode, and then the gray scale of the display device can be presented.

The pixel electrode and the common electrode are generally called as driving electrodes; generally speaking, the common electrode voltage is kept constant, therefore, the polarity of the driving electrode is determined compared with the common electrode. The polarity of the driving electrode is positive when the pixel electrode's voltage is higher than the common electrode's voltage, and the polarity of the driving electrode is negative when the pixel electrode's voltage is lower than the common electrode's voltage. Only is the rotation direction of the liquid crystal molecules affected when the polarity of the driving electrode is inversed, but the transmittance of the liquid crystal layer is determined by the electrical field value between the common electrode and the pixel electrode.

For example, the polarity of the driving electrode is positive when the common electrode voltage is 1V and the pixel electrode voltage is 3V; the polarity of the driving electrode is negative when the common electrode voltage is 1V and the pixel electrode voltage is −1V. In addition, the rotation degree of the liquid crystal molecules (i.e., transmittance of the liquid crystal layer) is kept the same for the above-mentioned two voltages of the pixel electrode.

In display operations, irreversible damages can be caused if the liquid crystal molecules of an LCD continue working under a single polarity in a long time period. Therefore, it is necessary to inverse the polarity between the driving electrodes periodically, i.e., alternate between the positive polarity and the negative polarity. Polarity inversion can be conducted by means of frame inversion, row inversion, column inversion, dot inversion and so on. Compared with frame inversion, row inversion and column inversion, dot inversion can further ensures normal rotation/orientation of the liquid crystal molecules for long operation time.

SUMMARY

An embodiment of the present disclosure provides an array substrate, comprising: a plurality of gate lines parallel with each other; a plurality of data lines parallel with each other, and the plurality of data lines intersecting with the gate lines; a plurality of sub-pixel units, each of the sub-pixel units including a first sub-pixel and a second sub-pixel, which are arranged with a same sequence along a gate line direction; each row of sub-pixel units along the gate line direction are driven by two gate lines, and different rows of sub-pixel units are driven by different gate lines; each column of sub-pixel units along the data line direction are driven by two data lines; the first sub-pixel and the second sub-pixel in each sub-pixel unit are driven by different gate lines and different data lines, and as for the sub-pixels in each column, the sub-pixels in odd-numbered rows are driven by same one data line, the sub-pixels in even-numbered rows are driven by same the other data line.

Another embodiment of the present disclosure provides a display device, comprising the above array substrate and at least one data driver; the data driver provides a data signal for a plurality of data lines.

Further another embodiment of the present disclosure provides a driving method for the above display device, comprising: in a frame scanning period, applying scanning signals into a plurality of gate lines, and applying a first type of signals into first data lines, and applying a second type of signals into second data lines; in a next frame scanning period, applying scanning signals into the plurality of gate lines, and applying the first type of signals into the second data lines, and applying the second type of signals into the first data lines. The voltages of the first type signals are higher than the voltage of the common electrode, and the voltages of the second type of signals are lower than the voltage of the common electrode.

BRIEF DESCRIPTION OF THE DRAWINGS

In order to clearly illustrate the technical solution of the embodiments of the disclosure or the technical solution of the prior art, the drawings of the embodiments or the prior art will be briefly described in the following; it is obvious that the described drawings are only related to some embodiments of the disclosure, based on the described drawings herein, those skilled in the art can obtain other drawings(s), without any inventive work.

DETAILED DESCRIPTION

The technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
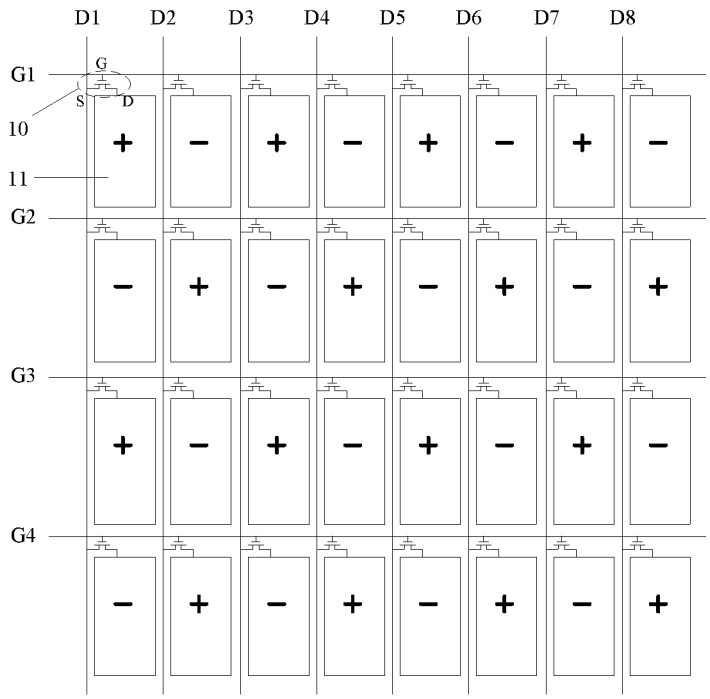
FIG. 1 is a structural schematic diagram of the connection relationship between sub-pixels of an array substrate.

Dot inversion mode is illustrated in FIG. 1. The polarities of any two adjacent sub-pixels, which are arranged along the row direction or the column direction, are opposite to each other. In order to realize dot inversion in the column direction, scanning signals are sequentially inputted into the plurality of gate lines illustrated in FIG. 1, so as to sequentially switch on the switching elements (e.g., TFT) controlled by the gate lines. The voltages applied to the data lines D1, D3, D5, and D7 are higher than the voltage of the common electrode in the time period when the gate lines G1 and G3 are switched on; the voltages applied to the data lines D1, D3, D5, and D7 are lower than the voltage of the common electrode in the time period when the gate lines G2 and G4 are switched on. The voltages applied to the data lines D2, D4, D6, and D8 are lower than the voltage of the common electrode in the time period when the gate lines G1 and G3 are switched on; the voltages applied to the data lines D2, D4, D6, and D8 are higher than the voltage of the common electrode in the time period when the gate lines G2 and G4 are switched on. That is, in a single frame scanning period, an inversion between a high level and a low level has to be implemented with respect to any data line when the scanning operation is switched from one gate line to the next gate line. Therefore, in order to realize dot inversion in the column direction, the power consumption for driving the data lines is high.

The present disclosure provides an array substrate, which comprises: a plurality of gate lines parallel with each other, a plurality of data lines parallel with each other, and a plurality of sub-pixel units. The plurality of sub-pixel units is defined by the plurality of data lines and the plurality of gate lines, which intersect with each other to obtain an array.

Each of the sub-pixel units includes a first sub-pixel and a second sub-pixel, which are arranged with the same sequence along the gate line direction. Each row of sub-pixel units along the gate line direction are driven by two gate lines, and different rows of sub-pixel units are driven by different gate lines; each column of sub-pixel units along the data line direction are driven by two data lines. The first sub-pixel and the second sub-pixel in each sub-pixel unit are driven by different gate lines and different data lines; for the sub-pixels in each column, the sub-pixels in odd-numbered rows are driven by same one data line, while the sub-pixels in even-numbered rows are driven by same the other data line.

Figure 2:
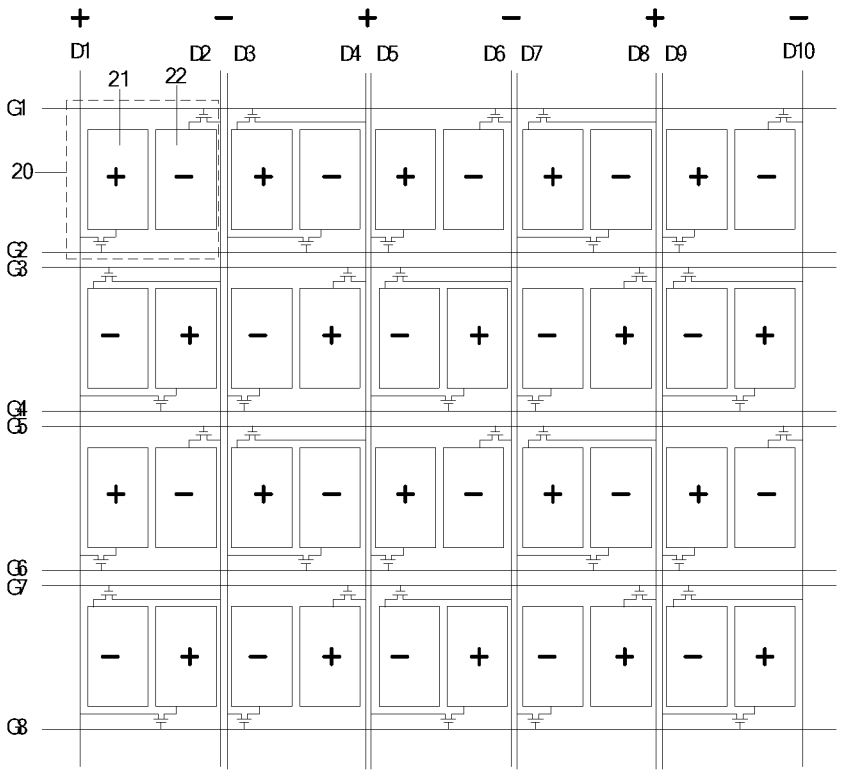
FIG. 2 is the first structural schematic diagram of the connection relationship between sub-pixels of an array substrate provided by an embodiment of the present disclosure.

For example, as illustrated in FIG. 2, the array substrate is described with reference to the following example: each row of sub-pixel units 20 are driven by two gate lines respectively arranged at its both sides, each column of sub-pixel units 20 are driven by two data lines respectively arranged at its both sides. The exemplary array substrate illustrated in FIG. 2 comprises eight (8) gate lines (G1-G8) parallel with each other, 10 data lines (D1-D10) parallel with each other, thus four (4) rows and five (5) columns of sub-pixel units 20 are defined and provided. The pixel units 20 in an odd-numbered row comprises a first sub-pixel 21 and a second sub-pixel unit 22 arranged sequentially along the gate line direction, the pixel units 20 in an even-numbered row comprises a first sub-pixel unit 21 and a second sub-pixel 22 arranged sequentially along the gate line direction.

Along the gate line direction, the first row of the sub-pixel units are driven by the gate lines G1 and G2, the second row of the sub-pixel units are driven by the gate lines G3 and G4, the third row of the sub-pixel units are driven by the gate lines G5 and G6, and the fourth row of the sub-pixel units are driven by the gate lines G7 and G8. Along the data line direction, the first column of the sub-pixel units are driven by the data lines D1 and D2, the second column of the sub-pixel units are driven by the data lines D3 and D4, the third column of the sub-pixel units are driven by the data lines D5 and D6, the fourth column of the sub-pixel units are driven by the data lines D7 and D8, and the fifth column of the sub-pixel units are driven by the data lines D9 and D10. In addition, the first sub-pixel 21 and the second sub-pixel 22 in each sub-pixel unit 20 are driven by different gate lines and different data lines, for the sub-pixels in each column, the sub-pixels in the odd-numbered rows are driven by same one data line, the sub-pixels in even-numbered rows are driven by same the other data line. The first sub-pixel 21 and the second sub-pixel 22 in each sub-pixel unit 20 are located in two adjacent columns of sub-pixels, respectively.

Base on the above connection method for the array substrate, in a driving operation, a gate drive circuit outputs gate scanning signals, which sequentially switch on the plurality of gate lines (G1-G8); a source drive circuit outputs source driving signals (data signals) to the data lines. In a single frame scanning period of the gate drive circuit (i.e., the time interval between the starting time of scanning the gate line G1 this time and that of scanning the gate line G1 next time), for display the source drive circuit sets the voltages applied to the data lines D1, D4, D5, D8 and D9 with positive values (i.e., higher) compared with the common voltage applied to the common electrode, while sets the voltages applied to the data lines D2, D3, D6, D7 and D10 with negative values (i.e., lower) compared with the common voltage applied to the common electrode; in this way, the polarities of any two adjacent sub-pixels are opposite to each other. In the next frame scanning period of the gate drive circuit, the source drive circuit sets the voltages applied to the data lines D1, D4, D5, D8 and D9 with negative values compared with the common voltage applied to the common electrode, while sets the voltages applied to the data line D2, D3, D6, D7 and D10 with positive values compared with the common voltage applied to the common electrode; in this way, the polarities of any two adjacent sub-pixels are opposite to each other, and also the polarity of any sub-pixel is inversed compare with its polarity in the last scanning period. Therefore, dot inversion in the column direction of the display device, which includes the above-mentioned array substrate, can be realized through the above-mentioned connection method for the pixels on the array substrate. Furthermore, the source drive circuit only needs to implement a single inversion between the high level and the low level in one frame scanning period of the gate drive circuit, therefore, the power consumption of the display device, which includes the above-mentioned array substrate, can be decreased.

The array substrate provided by an embodiment of the present disclosure comprises a plurality of gate lines parallel with each other, a plurality of data lines parallel with each other, and a plurality of sub-pixel units, each of the sub-pixel units including a first sub-pixel and a second sub-pixel, which are arranged with the same sequence along the gate line direction; each row of sub-pixel units along the gate line direction are driven by two gate lines, and different rows of sub-pixel units are driven by different gate lines; each column of sub-pixel units along the data line direction are driven by two data lines; the first sub-pixel and the second sub-pixel in each sub-pixel unit are driven by different gate lines and different data lines; for the sub-pixels in each column, the sub-pixels in odd-numbered rows are driven by same one data line, the sub-pixels in even-numbered rows are driven by same the other data line. In order to realize dot inversion in the column direction, the array substrate illustrated in FIG. 1 needs to implement an inversion between high level and low level for the data lines when the scanning operation is switched from one gate line to the next gate line; however the data lines in the embodiments of the present disclosure only need to implement a single inversion between high level and low level in one frame scanning period, this is because the following reasons: the first sub-pixel and the second sub-pixel in each sub-pixel unit are driven by different gate lines and different data lines, and for the sub-pixels in each column, the sub-pixels in odd-numbered rows are driven by same one data line, the sub-pixels in even-numbered rows are driven by same the other data line; therefore, the connection method for the pixels on the array substrate provided by the embodiment of the present disclosure allows the display device, which includes the above-mentioned array substrate, to realize dot inversion in the column direction with low power consumption for driving the data lines.

It should be understood for those skilled in the related art that although the above-mentioned embodiment adopt the following arrangement: each row of sub-pixel units are driven by two gate lines respectively arranged at its both sides and each column of sub-pixel units are driven by two data lines respectively arranged at its both sides, the above-mentioned arrangement method is only a preferably implementation example in consistent with the embodiment of the present disclosure, and it should not recognized as an limitation upon the embodiment of the present disclosure. Those skilled in the art can conceive other arrangement manners based on above exemplary arraignment. For example, it is possible to configure two gate lines, which drive each row of the sub-pixel units, on the same side of the row of the sub-pixel units; or, it is possible to configure two data lines, which drive each column of the sub-pixel units, on the same side of the column of the sub-pixel units. However, the above-mentioned examples are reasonable modification of the above embodiments, and should be within the scope of the disclosure.

Furthermore, in one example of the array substrate provided by the above-mentioned embodiment, one data line can be configured between two adjacent columns of sub-pixel units, two adjacent columns of sub-pixel units share the data line; two sub-pixels, which are adjacent along the gate line direction and connected to the same data line, are driven by different gate lines.

The example provided by the above-mentioned embodiment can also allow the display device, which includes the above-mentioned array substrate, to realize dot inversion in the column direction with low power consumption for driving the data lines through the following arrangement: only one data line is configured between two adjacent columns of sub-pixel units, and two adjacent columns of sub-pixel units share the data line; and two sub-pixels, which are adjacent along the gate line direction and connected to the same data line, are driven by different gate lines. Because only one data line is configured between two adjacent columns of sub-pixel units, and two adjacent columns of sub-pixel units share the data line, the number of the data lines on the array substrate can be reduced, and therefore, the process of manufacturing array substrate can be simplified, the manufacturing cost of the array substrate can be reduced, and the aperture ratio of the display panel, which includes above-mentioned array substrate, can be increased.

The array substrate provided by the above-mentioned embodiment involves at least four exemplary implementation manners in the following for example, and the above-mentioned four exemplary implementation methods will be described in detail below.

EXAMPLE 1

Among the sub-pixel units in both odd-numbered rows and in odd-numbered columns as well, the first sub-pixels are driven by odd-numbered gate lines and odd-numbered data lines; and the second sub-pixels are driven by even-numbered gate lines and even-numbered data lines.

Among the sub-pixel units in both even-numbered rows and in odd-numbered columns as well, the first sub-pixels are driven by odd-numbered gate lines and even-numbered data lines; and the second sub-pixels are driven by even-numbered gate lines and odd-numbered data lines.

Among the sub-pixel units in both odd-numbered rows and in even-numbered columns as well, the first sub-pixels are driven by even-numbered gate lines and odd-numbered data lines; and the second sub-pixels are driven by odd-numbered gate lines and even-numbered data lines.

Among the sub-pixel units in both even-numbered rows and in even-numbered columns as well, the first sub-pixels are driven by even-numbered gate lines and even-numbered data lines; and the second sub-pixels are driven by odd-numbered gate lines and odd-numbered data lines.

Figure 3:
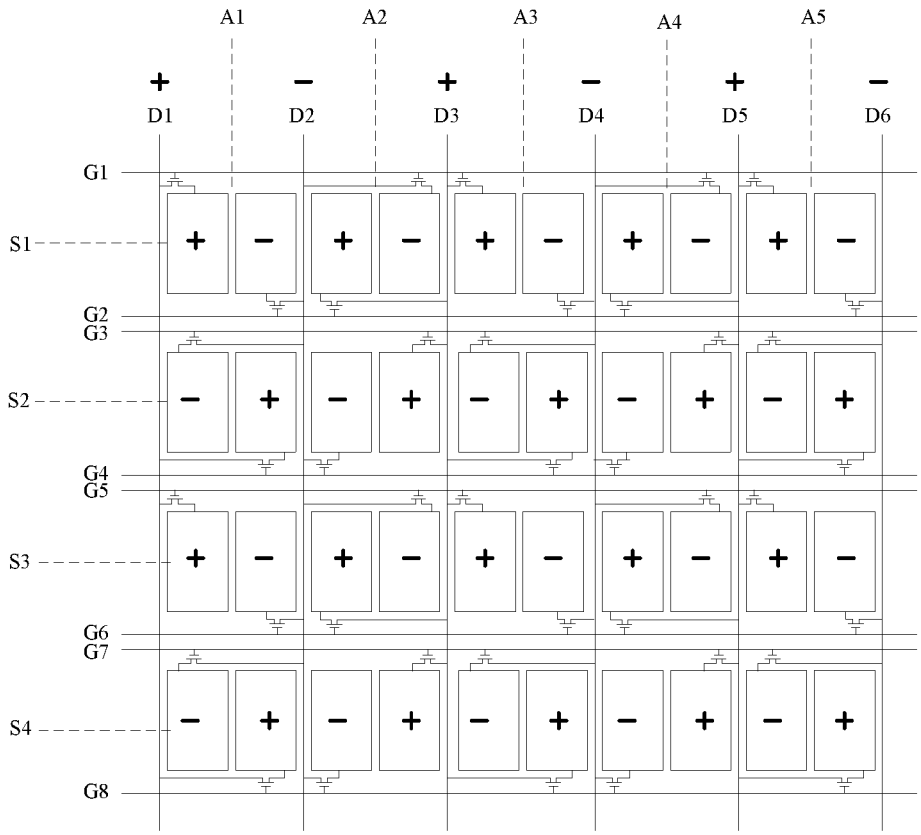
FIG. 3 is the second structural schematic diagram of the connection relationship between sub-pixels of an array substrate provided by the embodiment of the present disclosure.

For example, the exemplary array substrate as illustrated in FIG. 3 comprises: eight (8) gate lines (G1-G8) parallel with each other and six (6) data lines (D1-D6) parallel with each other, and therefore four (4) rows (S1-S4) and five (5) columns (A1-A5) of sub-pixel units are defined and provided.

Among the sub-pixel units in both odd-numbered rows and in odd-numbered columns as well (i.e., the sub-pixels in the positions S1A1, S1A3, S1A5, S3A1, S3A3, and S3A5), the first sub-pixels are driven by odd-numbered gate lines and odd-numbered data lines; the second sub-pixels are driven by even-numbered gate lines and even-numbered data lines. For example, more specifically, the first sub-pixel in S1A1 is driven by the gate line G1 and the data line D1, the first sub-pixel in S1A3 is driven by the gate line G1 and the data line D3, the first sub-pixel in S1A5 is driven by the gate line G1 and the data line D5, the first sub-pixel in S3A1 is driven by the gate line G3 and the data line D1, the first sub-pixel in S3A3 is driven by the gate line G3 and the data line D3, the first sub-pixel in S3A5 is driven by the gate line G3 and the data line D5; the second sub-pixel in S1A1 is driven by the gate line G2 and the data line D2, the second sub-pixel in S1A3 is driven by the gate line G2 and the data line D4, the second sub-pixel in S1A5 is driven by the gate line G2 and the data line D6, the second sub-pixel in S3A1 is driven by the gate line G6 and the data line D2, the second sub-pixel in S3A3 is driven by the gate line G6 and the data line D4, and the second sub-pixel in S3A5 is driven by the gate line G6 and the data line D6.

Among the sub-pixel units in both even-numbered rows and in odd-numbered columns as well (i.e., the sub-pixels in the positions S2A1, S2A3, S2A5, S4A1, S4A3, S4A5), the first sub-pixels are driven by odd-numbered gate lines and even-numbered data lines; the second sub-pixels are driven by even-numbered gate lines and odd-numbered data lines. For example, more specific the first sub-pixel in S2A1 is driven by the gate line G3 and the data line D2, the first sub-pixel in S2A3 is driven by the gate line G3 and the data line D4, the first sub-pixel in S2A5 is driven by the gate line G3 and the data line D6, the first sub-pixel in S4A1 is driven by the gate line G7 and The data line D2, the first sub-pixel in S4A3 is driven by the gate line G7 and the data line D4, and the first sub-pixel in S4A5 is driven by the gate line G7 and the data line D6; the second sub-pixel in S2A1 is driven by the gate line G4 and the data line D1, the second sub-pixel in S2A3 is driven by the gate line G4 and the data line D3, the second sub-pixel in S2A5 is driven by the gate line G4 and the data line D5, the second sub-pixel in S4A1 is driven by the gate line G8 and the data line D1, the second sub-pixel in S4A3 is driven by the gate line G8 and the data line D3, and the second sub-pixel in S4A5 is driven by the gate line G8 and the data line D5.

Among the sub-pixel units in both odd-numbered rows and in even-numbered columns as well (i.e., the sub-pixels in the positions S1A2, S1A4, S3A2, S3A4), the first sub-pixels are driven by even-numbered gate lines and odd-numbered data lines; the second sub-pixels are driven by odd-numbered gate lines and even-numbered data lines. For example, more specific, the first sub-pixel in S1A2 is driven by the gate line G2 and the data line D3, the first sub-pixel in S1A4 is driven by the gate line G2 and the data line D5, the first sub-pixel in S3A2 is driven by the gate line G6 and the data line D3, and the first sub-pixel in S3A4 is driven by the gate line G6 and the data line D5; the second sub-pixel in S1A2 is driven by the gate line G1 and the data line D2, the second sub-pixel in S1A4 is driven by the gate line G1 and the data line D4, the second sub-pixel in S3A2 is driven by the gate line G5 and the data line D2, and the second sub-pixel in S3A4 is driven by the gate line G5 and the data line D4.

Among the sub-pixel units in both even-numbered rows and in even-numbered columns as well (i.e., the sub-pixels in the positions S2A2, S2A4, S4A2, S4A4), the first sub-pixels are driven by even-numbered gate lines and even-numbered data lines; the second sub-pixels are driven by odd-numbered gate lines and odd-numbered data lines. For example, more specific, the first sub-pixel in S2A2 is driven by the gate line G4 and the data line D2, the first sub-pixel in S2A4 is driven by the gate line G4 and the data line D4, the first sub-pixel in S4A2 is driven by the gate line G8 and the data line D2, and the first sub-pixel in S4A4 is driven by the gate line G8 and the data line D4; the second sub-pixel in S2A2 is driven by the gate line G3 and the data line D3, the second sub-pixel in S2A4 is driven by the gate line G3 and the data line D5, the second sub-pixel in S4A2 is driven by the gate line G7 and the data line D3, and the second sub-pixel in S4A4 is driven by the gate line G7 and the data line D5.

In this example, the driving method for the gate driver and the data driver (source driver) is, for example, as follows. The gate drive circuit outputs gate scanning signals, which sequentially switch on the plurality of gate lines (G1-G8); the source drive circuit outputs source driving signals to the data lines (D1-D6). In a single frame scanning period of the gate drive circuit, the source drive circuit sets the voltages of the data lines D1, D3, and D5 with positive values compared with the common voltage of the common electrode, while sets the voltages of the data lines D2, D4, and D6 with negative values compared with the common voltage of the common electrode; in the next frame scanning period of the gate drive circuit, the source drive circuit sets the voltages of the data lines D1, D3, and D5 with negative values compared with the common voltage of the common electrode, while sets the voltages of the data lines D2, D4, and D6 with positive values compared with the common voltage of the common electrode; therefore, the driving method allows the display device, which includes the above-mentioned array substrate, to realize dot inversion in the column direction with low power consumption for driving the data lines.

EXAMPLE 2

Among the sub-pixel units in both odd-numbered rows and in odd-numbered columns as well, the first sub-pixels are driven by odd-numbered gate lines and odd-numbered data lines; the second sub-pixels are driven by even-numbered gate lines and even-numbered data lines.

Among the sub-pixel units in both even-numbered rows and in odd-numbered columns as well, the first sub-pixels are driven by even-numbered gate lines and even-numbered data lines; the second sub-pixels are driven by odd-numbered gate lines and odd-numbered data lines.

Among the sub-pixel units in both odd-numbered rows and in even-numbered columns as well, the first sub-pixels are driven by even-numbered gate lines and odd-numbered data lines; the second sub-pixels are driven by odd-numbered gate lines and even-numbered data lines.

Among the sub-pixel units in both even-numbered rows and in even-numbered columns as well, the first sub-pixels are driven by odd-numbered gate lines and even-numbered data lines; the second sub-pixels are driven by even-numbered gate lines and odd-numbered data lines.

Figure 4:
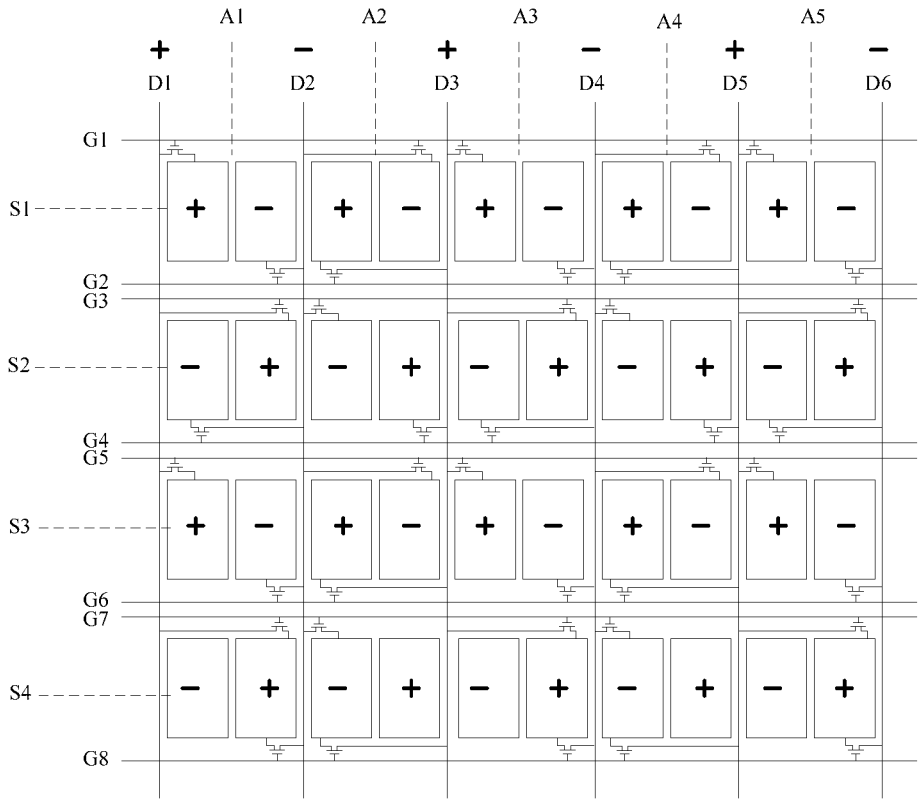
FIG. 4 is the third structural schematic diagram of the connection relationship between sub-pixels of an array substrate provided by the embodiment of the present disclosure.

For example, the exemplary array substrate as illustrated in FIG. 4 comprises: eight (8) gate lines (G1-G8) parallel with each other and six (6) data lines (D1-D6) parallel with each other, and therefore four (4) rows (S1-S4) and five (5) columns (A1-A5) sub-pixel units are defined and provided.

Among the sub-pixel units in both odd-numbered rows and in odd-numbered columns as well (i.e., the sub-pixels in the positions S1A1, S1A3, S1A5, S3A1, S3A3, S3A5), the first sub-pixels are driven by odd-numbered gate lines and odd-numbered data lines; the second sub-pixels are driven by even-numbered gate lines and even-numbered data lines. Among the sub-pixel units in both even-numbered rows and in odd-numbered columns as well (i.e., the sub-pixels in the positions S2A1, S2A3, S2A5, S4A1, S4A3, S4A5), the first sub-pixels are driven by even-numbered gate lines and even-numbered data lines; the second sub-pixels are driven by odd-numbered gate lines and odd-numbered data lines. Among the sub-pixel units in both odd-numbered rows and in even-numbered columns as well (i.e., the sub-pixels in the positions S1A2, S1A4, S3A2, S3A4), the first sub-pixels are driven by even-numbered gate lines and odd-numbered data lines; the second sub-pixels are driven by odd-numbered gate lines and even-numbered data lines. Among the sub-pixel units in both even-numbered rows and in even-numbered columns as well (i.e., the sub-pixels in the positions S2A2, S2A4, S4A2, S4A4), the first sub-pixels are driven by odd-numbered gate lines and even-numbered data lines; the second sub-pixels are driven by even-numbered gate lines and odd-numbered data lines.

The driving method for realizing dot inversion of each sub-pixel on the array substrate provided by the above-mentioned embodiment is similar to the driving method provided by example 1, and therefore for the sake of clarity, no further description will be given.

EXAMPLE 3

Among the sub-pixel units in both odd-numbered rows and in odd-numbered columns as well, the first sub-pixels are driven by even-numbered gate lines and odd-numbered data lines; the second sub-pixels are driven by odd-numbered gate lines and even-numbered data lines.

Among the sub-pixel units in both even-numbered rows and in odd-numbered columns as well, the first sub-pixels are driven by odd-numbered gate lines and even-numbered data lines; the second sub-pixels are driven by even-numbered gate lines and odd-numbered data lines.

Among the sub-pixel units in both odd-numbered rows and in even-numbered columns as well, the first sub-pixels are driven by odd-numbered gate lines and odd-numbered data lines; the second sub-pixels are driven by even-numbered gate lines and even-numbered data lines.

Among the sub-pixel units in both even-numbered rows and in even-numbered columns as well, the first sub-pixels are driven by even-numbered gate lines and even-numbered data lines; the second sub-pixels are driven by odd-numbered gate lines and odd-numbered data lines.

Figure 5:
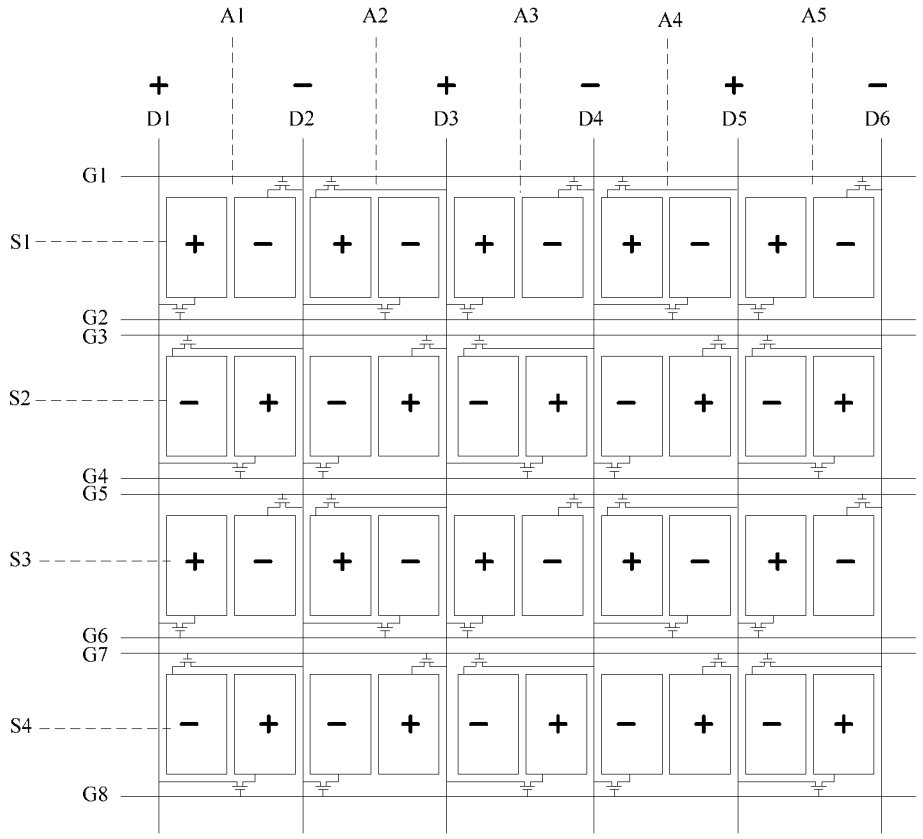
FIG. 5 is the fourth structural schematic diagram of the connection relationship between sub-pixels of an array substrate provided by the embodiment of the present disclosure.

For example, the exemplary array substrate as illustrated in FIG. 5 comprises: eight (8) gate lines (G1-G8) parallel with each other and six (6) data lines (D1-D6) parallel with each other, and therefore four (4) rows (S1-S4) and five (5) columns (A1-A5) sub-pixel units.

Among the sub-pixel units in both odd-numbered rows and in odd-numbered columns as well (i.e., the sub-pixels in the positions S1A1, S1A3, S1A5, S3A1, S3A3, S3A5), the first sub-pixels are driven by even-numbered gate lines and odd-numbered data lines; the second sub-pixels are driven by odd-numbered gate lines and even-numbered data lines. Among the sub-pixel units in both even-numbered rows and in odd-numbered columns as well (i.e., the sub-pixels in the positions S2A1, S2A3, S2A5, S4A1, S4A3, S4A5), the first sub-pixels are driven by odd-numbered gate lines and even-numbered data lines; the second sub-pixels are driven by even-numbered gate lines and odd-numbered data lines. Among the sub-pixel units in both odd-numbered rows and in even-numbered columns as well (i.e., the sub-pixels in the positions S1A2, S1A4, S3A2, S3A4), the first sub-pixels are driven by odd-numbered gate lines and odd-numbered data lines; the second sub-pixels are driven by even-numbered gate lines and even-numbered data lines. Among the sub-pixel units in both even-numbered rows and in even-numbered columns as well (i.e., the sub-pixels in the positions S2A2, S2A4, S4A2, S4A4), the first sub-pixels are driven by even-numbered gate lines and even-numbered data lines; the second sub-pixels are driven by odd-numbered gate lines and odd-numbered data lines.

Similarly, the driving method for realize dot inversion of each sub-pixel on the array substrate provided by the above-mentioned embodiment is similar to the driving method provided by example 1, and therefore for the sake of clarity, no further description will be given.

EXAMPLE 4

Among the sub-pixel units in both odd-numbered rows and in odd-numbered columns as well, the first sub-pixels are driven by even-numbered gate lines and odd-numbered data lines; the second sub-pixels are driven by odd-numbered gate lines and even-numbered data lines.

Among the sub-pixel units in both even-numbered rows and in odd-numbered columns as well, the first sub-pixels are driven by even-numbered gate lines and even-numbered data lines; the second sub-pixels are driven by odd-numbered gate lines and odd-numbered data lines.

Among the sub-pixel units in both odd-numbered rows and in even-numbered columns as well, the first sub-pixels are driven by odd-numbered gate lines and odd-numbered data lines; the second sub-pixels are driven by even-numbered gate lines and even-numbered data lines.

Among the sub-pixel units in both even-numbered rows and in an even-numbered column as well, the first sub-pixels are driven by odd-numbered gate lines and even-numbered data lines; the second sub-pixels are driven by even-numbered gate lines and odd-numbered data lines.

Figure 6:
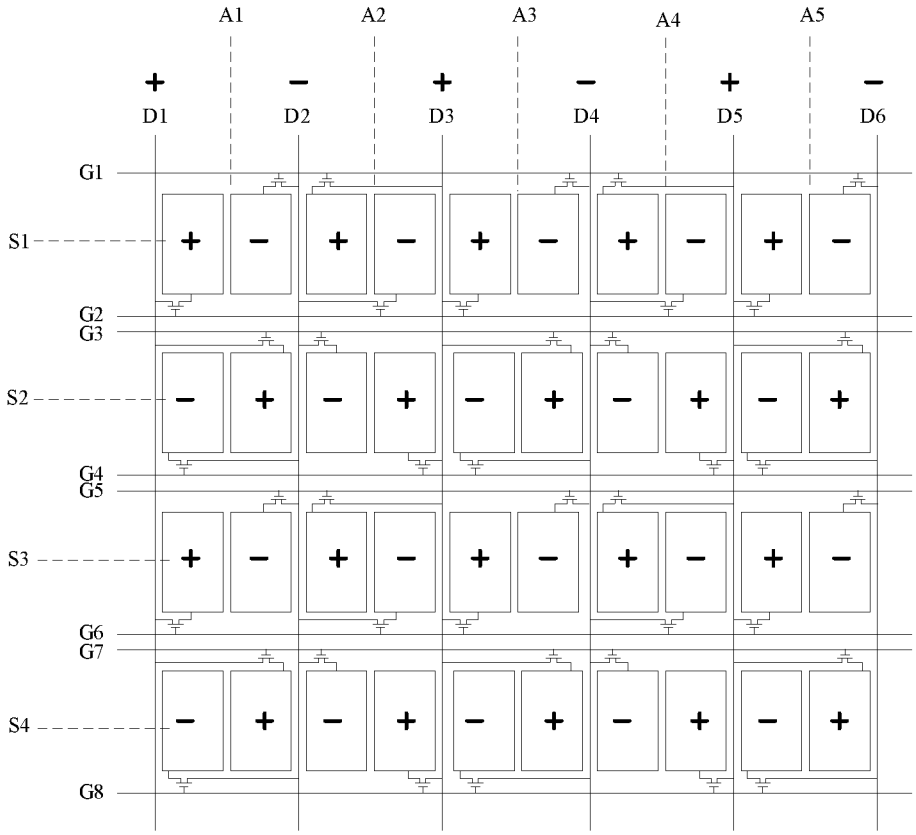
FIG. 6 is the fifth structural schematic diagram of the connection relationship between sub-pixels of an array substrate provided by the embodiment of the present disclosure.

For example, the exemplary array substrate as illustrated in FIG. 6 comprises: eight (8) gate lines (G1-G8) parallel with each other and (6) data lines (D1-D6) parallel with each other, and therefore four (4) rows (S1-S4) and five (5) columns (A1-A5) sub-pixel units are defined and provided.

Among the sub-pixel units in both odd-numbered rows and in odd-numbered columns as well (i.e., the sub-pixels in the positions S1A1, S1A3, S1A5, S3A1, S3A3, S3A5), the first sub-pixels are driven by even-numbered gate lines and odd-numbered data lines; the second sub-pixels are driven by odd-numbered gate lines and even-numbered data lines. Among the sub-pixel units in both even-numbered rows and in odd-numbered columns as well (i.e., the sub-pixels in the positions S2A1, S2A3, S2A5, S4A1, S4A3, S4A5), the first sub-pixels are driven by even-numbered gate lines and even-numbered data lines; the second sub-pixels are driven by odd-numbered gate lines and odd-numbered data lines. Among the sub-pixel units in both odd-numbered rows and in even-numbered columns as well (i.e., the sub-pixels in the positions S1A2, S1A4, S3A2, S3A4), the first sub-pixels are driven by odd-numbered gate lines and odd-numbered data lines; the second sub-pixels are driven by even-numbered gate lines and even-numbered data lines. Among the sub-pixel units in the even-numbered rows and in even-numbered columns as well (i.e., the sub-pixels in the positions S2A2, S2A4, S4A2, S4A4), the first sub-pixels are driven by odd-numbered gate lines and even-numbered data lines; the second sub-pixels are driven by even-numbered gate lines and odd-numbered data lines.

Similarly, the driving method for realize dot inversion of each sub-pixel on the array substrate provided by the above-mentioned embodiment is similar to the driving method provided by example 1, and therefore for the sake of clarity, no further description will be given.

Another embodiment of the present disclosure provides a display device, which comprises an array substrate provided by any one of above-mentioned embodiments, and at least one data driver. The data driver provides data signals for a plurality of data lines. The display device further comprises a gate driver, which provides row scanning signals for a plurality of gate lines. The display device further comprises a common electrode, which generates an electrical field in cooperation with a pixel electrode; the electrical field is used for control the orientation of the liquid crystal molecules.

Figure 8:
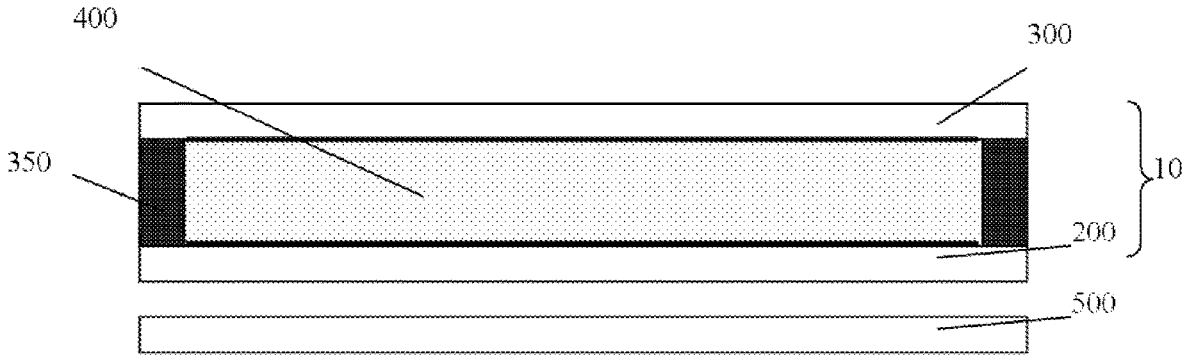
FIG. 8 is a schematic diagram of the display device according to an embodiment of the present disclosure.

FIG. 8 is a schematic diagram of the display device according to an embodiment of the present disclosure. As illustrated in FIG. 8, the display device 10 comprises an array substrate 200 and an opposed substrate 300. The array substrate 200 and the opposed substrate 300 are configured opposite to each other, and then a liquid crystal cell is formed by means of a sealant 350, and a liquid crystal layer 400 is disposed in the liquid crystal cell. The opposed substrate 300 is, for example, a color filter substrate. Each sub-pixel on the array substrate comprises a pixel electrode and a thin film transistor functioning as a switching component. In some examples, the display device further comprises a backlight 500, which is configured for providing a light source for the array substrate.

The common electrode of the display device can be provided at different positions according to types of the display device. For a vertical electrical field type (for example TN type) display device, the common electrode is provided on the opposed substrate, for example, as a surface electrode covering the whole display area of the opposed substrate. For a horizontal electric field type (for example, IPS type or ADS type) display device, the common electrode is provided on the array substrate, for example, the common electrode is configured on the same layer as the pixel electrodes or on a different layer from the pixel electrodes, and the common electrode can be connected to a common line so that it can be applied with a common voltage.

For example, the display device can be any products or devices that have display function, such as an electronic paper, a mobile phone, a tablet computer, a television, a display, a laptop, a digital photo frame, a navigator or the like.

The array substrate of the display device provided by an embodiment of the present disclosure comprises a plurality of gate lines parallel with each other, a plurality of data lines parallel with each other, and a plurality of sub-pixel units, each of the sub-pixel units including a first sub-pixel and a second sub-pixel, which are arranged with the same sequence along the gate line direction; each row of sub-pixel units along the gate line direction are driven by two gate lines, and different rows of sub-pixel units are driven by different gate lines; each column of sub-pixel units along the data line direction are driven by two data lines; the first sub-pixel and the second sub-pixel in each sub-pixel unit are driven by different gate lines and different data lines, for the sub-pixels in each column, the sub-pixels in odd-numbered rows are driven by same one data line, and the sub-pixels in even-numbered rows are driven by same the other data line. In order to realize dot inversion in column direction, the array substrate as illustrated in FIG. 1 needs to implement an inversion between high level and low level for data lines when the scanning operation is switched from one gate line to the next gate line, while the data lines in the embodiments of the present disclosure only need to implement a single inversion between high level and low level in one frame scanning period; this is because the following reasons: the first sub-pixel and the second sub-pixel in each sub-pixel unit are driven by different gate lines and different data lines, and for the sub-pixels in each column, the sub-pixels in odd-numbered rows are driven by same one data line, the sub-pixels in even-numbered rows are driven by same the other data line; therefore, the connection method for the pixels on the array substrate provided by the embodiment of the present disclosure allows the display device, which includes the above-mentioned array substrate, to realize dot inversion in the column direction with low power consumption for driving the data lines.

Figure 7:
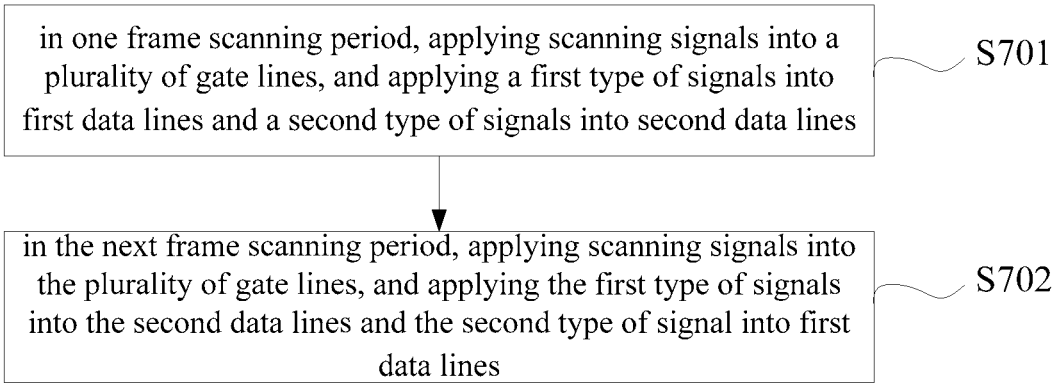
FIG. 7 is a flow chart of a driving method of a display device provided by the present disclosure.

Another embodiment of the present disclosure provides a driving method for the display device provided by the above-mentioned embodiment. As illustrated in FIG. 7, the embodiment comprises the following operations:

S701: in a frame scanning period, applying scanning signals into a plurality of gate lines sequentially, and applying a first type of signals into first data lines, and applying a second type of signals into second data lines.

S702: in a next frame scanning period, applying scanning signals into the plurality of gate lines sequentially, and applying the first type of signals into the second data lines, and applying the second type of signals into the first data lines.

The voltages of the first type of signals (signals of positive polarity) are higher than the voltage of the common electrode, and the voltages of the second type of signals (signals of negative polarity) are lower than the voltage of the common electrode. Moreover, the first type of signals applied to the first data lines in operation S701 may be different in value from the first type of signals applied to the first data lines in operation S702; also, the second type of signals applied to the second data lines in operation S701 may be different in value from the second type of signals applied to the second data lines in operation S702. For example, the first data lines are odd-numbered data lines while the second data lines are even-numbered data lines; alternatively, the first data lines are even-numbered data lines while the second data lines are odd-numbered data lines. The next frame scanning period is immediately following the one frame scanning period.

The dot inversion in the column direction of the display device provided by the above embodiment can be realized through the following method: in one frame scanning period, applying scanning signals into a plurality of gate lines sequentially, and applying first signals into first data lines, and applying second signals into second data lines; in the next frame scanning period, applying scanning signals into the plurality of gate lines sequentially, and applying first signals into the second data lines, and applying second signals into the first data lines. Because the signals of the data lines only need one inversion in a single frame scanning period, the power consumption of the display device can be reduced.

It's apparent for those skilled in the art that all of the steps or part of the steps to realize the above method can be accomplished through hardware relative to programs or instructions; the steps of the above method provided by the embodiment is implemented during the execution of the above program; the above storage medium include any of mediums which can store the program, such as ROM, RAM, diskette, CD, and so on.

What are described above is related to the illustrative embodiments of the disclosure only and not limitative to the scope of the disclosure; with the technical content disclosed by the present disclosure, those skilled in the art can easily envisage modifications or substitutions, which should covered by the scope of the present invention. Therefore, the scopes of the disclosure are defined by the accompanying claims.

The application claims priority to the Chinese patent application No. 201610140950.3, filed Mar. 11, 2016, the entire disclosure of which is incorporated herein by reference as part of the present application.

What is claimed is:

1. A display device, comprising an array substrate, wherein the array substrate comprises:

a plurality of gate lines parallel with each other;

a plurality of data lines parallel with each other, wherein the data lines and the gate lines intersect with each other; and a plurality of sub-pixel units, wherein each of the sub-pixel units comprises a first sub-pixel and a second sub-pixel which are arranged with a same sequence along an extension direction of the gate lines;

each row of sub-pixel units along the extension direction of the gate lines is driven by two gate lines, and different rows of sub-pixel units are driven by different gate lines; each column of sub-pixel units along an extension direction of the data lines are driven by one of odd-numbered data lines and one of even-numbered data lines;

the first sub-pixel in each sub-pixel unit is driven by one of the two gate lines, and the second sub-pixel in each sub-pixel unit is driven by another of the two gate lines;

for sub-pixels in each column of the sub-pixel units, first sub-pixels in odd-numbered rows are driven by a same one odd-numbered data line, first sub-pixels in even-numbered rows are driven by a same one even-numbered data line, second sub-pixels in odd-numbered rows are driven by the one even-numbered data line, second sub-pixels in even-numbered rows are driven by the same one odd-numbered data line;

among sub-pixel units odd-numbered rows and in odd-numbered columns as well, the first sub-pixels are driven by odd-numbered data lines and the second sub-pixels are driven by even-numbered data lines;

among sub-pixels units in both even-numbered rows and in odd-numbered columns as well, the first sub-pixels are driven by even-numbered data lines and the second sub-pixels are driven by odd-numbered data lines;

among sub-pixels units in both odd-numbered rows and in even-numbered columns as well, the first sub-pixels are driven by odd-numbered data lines and the second sub-pixels are driven by even-numbered data lines; and among sub-pixels units in both even-numbered rows and in even-numbered columns as well, the first sub-pixels are driven by even-numbered data lines and the second sub-pixels are driven by odd-numbered data lines, wherein the display device further comprises a gate driver and a data driver;

in a frame scanning period, the gate driver is configured to apply scanning signals into the gate lines, and the data driver is configured to apply a first type of signals into odd-numbered data lines, and to apply a second type of signals into even-numbered data lines; and in a next frame scanning period, the gate driver is configured to apply the scanning signals into the gate lines, and the data driver is configured to apply the first type of signals into even-numbered data lines, and apply the second type of signals into odd-numbered data lines, wherein voltages of the first type of signals are higher than a voltage of a common electrode, and voltages of the second type of signals are lower than the voltage of the common electrode.

2. The display device according to claim 1, wherein the two gate lines are respectively arranged at two sides of the row of sub-pixel units.

3. The display device according to claim 2, wherein the one of odd-numbered data lines and the one of even-numbered data lines are respectively arranged at two sides of each column of the sub-pixel units.

4. The display device according to claim 3, wherein one of the data lines is configured between two adjacent columns of sub-pixel units, and the two adjacent columns of sub-pixel units share the one of the data lines; and two sub-pixels, which are located in two adjacent sub-pixel units along the extension direction of the gate lines and connected to the one of the data lines, are driven by different gate lines.

5. The display device according to claim 4, wherein, among the sub-pixel units in both odd-numbered rows and in odd-numbered columns as well, the first sub-pixels are driven by odd-numbered gate lines and the second sub-pixels are driven by even-numbered gate lines;

among the sub-pixel units in both even-numbered rows and in odd-numbered columns as well, the first sub-pixels are driven by odd-numbered gate lines and the second sub-pixels are driven by even-numbered gate lines;

among the sub-pixel units in both odd-numbered rows and in even-numbered columns as well, the first sub-pixels are driven by even-numbered gate lines and second sub-pixels are driven by odd-numbered gate lines; and among the sub-pixel units in both even-numbered rows and in even-numbered columns as well, the first sub-pixels are driven by even-numbered gate lines and the second sub-pixels are driven by odd-numbered gate lines.

6. The display device according to claim 4, wherein, among the sub-pixel units in both odd-numbered rows and in odd-numbered columns as well, the first sub-pixels are driven by odd-numbered gate lines and the second sub-pixels are driven by even-numbered gate lines;

among the sub-pixel units in both even-numbered rows and in odd-numbered columns as well, the first sub-pixels are driven by even-numbered gate lines and the second sub-pixels are driven by odd-numbered gate lines;

among the sub-pixel units in both odd-numbered rows and in even-numbered columns as well, the first sub-pixels are driven by even-numbered gate lines and the second sub-pixels are driven by odd-numbered gate lines; and among the sub-pixel units in both even-numbered rows and in even-numbered columns as well, the first sub-pixels are driven by odd-numbered gate lines and the second sub-pixels are driven by even-numbered gate lines.

7. The display device according to claim 4, wherein, among the sub-pixel units in both odd-numbered rows and in odd-numbered columns as well, the first sub-pixels are driven by even-numbered gate lines and the second sub-pixels are driven by odd-numbered gate lines;

among the sub-pixel units in both even-numbered rows and in odd-numbered columns as well, the first sub-pixels are driven by odd-numbered gate lines and the second sub-pixels are driven by even-numbered gate lines;

among the sub-pixel units in both odd-numbered rows and in even-numbered columns as well, the first sub-pixels are driven by odd-numbered gate lines and the second sub-pixels are driven by even-numbered gate lines; and among the sub-pixel units in both even-numbered rows and in even-numbered columns as well, the first sub-pixels are driven by even-numbered gate lines and the second sub-pixels are driven by odd-numbered gate lines.

8. The display device according to claim 4, wherein, among the sub-pixel units in both odd-numbered rows and in odd-numbered columns as well, the first sub-pixels are driven by even-numbered gate lines and the second sub-pixels are driven by odd-numbered gate lines;

among the sub-pixel units in both even-numbered rows and in odd-numbered columns as well, the first sub-pixels are driven by even-numbered gate lines and the second sub-pixels are driven by odd-numbered gate lines;

among the sub-pixel units in both odd-numbered rows and in even-numbered columns as well, the first sub-pixels are driven by odd-numbered gate lines and the second sub-pixels are driven by even-numbered gate lines; and among the sub-pixel units in both even-numbered rows and in even-numbered columns as well, the first sub-pixels are driven by odd-numbered gate lines and the second sub-pixels are driven by even-numbered gate lines.

9. The display device according to claim 1, further comprising the common electrode, which is provided on the array substrate.

10. The display device according to claim 1, further comprising an opposed substrate configured to be opposite to the array substrate, wherein the common electrode is provided on the opposed substrate.

11. A driving method for a display device including a plurality of gate lines parallel with each other, a plurality of data lines which are parallel with each other and intersecting with the gate lines, and a plurality of sub-pixel units, each of which including a first sub-pixel and a second sub-pixel which are arranged with a same sequence along an extension direction of the gate lines, comprising:

in a frame scanning period, applying scanning signals into the plurality of gate lines, and applying the first type of signals into odd-numbered data lines, so as to drive first sub-pixels in odd-numbered rows and second sub-pixels in even-numbered rows in each column of the sub-pixels units, and applying a second type of signals into even-numbered data lines, so as to drive first sub-pixels in even-numbered rows and second sub-pixels in odd-numbered rows in each column of the sub-pixel units; and in a next frame scanning period, applying the scanning signals into the plurality of gate lines, and applying the first type of signals into even-numbered data lines so as to drive the first sub-pixels in even-numbered rows and the second sub-pixels in odd-numbered rows in each column of the sub-pixel units, and applying the second type of signals into odd-numbered data lines so as to drive the first sub-pixels in odd-numbered rows and the second sub-pixels in even-numbered rows in each column of the sub-pixel units, wherein voltages of the first type of signals are higher than a voltage of a common electrode, and voltages of the second type of signals are lower than the voltage of the common electrode, each row of sub-pixel units along the extension direction of the gate lines is driven by two gate lines, and different rows of sub-pixel units are driven by different gate lines, each column of sub-pixel units along an extension direction of the data lines is driven by one of odd-numbered data lines and one of even-numbered data lines, the first sub-pixel in each sub-pixel unit is driven by one of the two gate lines, and the second sub-pixel in each sub-pixel unit is driven by another of the two gate lines, for sub-pixels in the each column of the sub-pixel units, first sub-pixels in odd-numbered rows are driven by a same one odd-numbered data line, first sub-pixels in even-numbered rows are driven by a same one even-numbered data line, second sub-pixels in odd-numbered rows are driven by the same one even-numbered data line, and second sub-pixels in even-numbered rows are driven by the same one odd-numbered data line, among sub-pixels units in both odd-numbered rows and in odd-numbered columns as well, the first sub-pixels are driven by odd-numbered data lines and the second sub-pixels are driven by even-numbered data lines, among sub-pixel units in both even-numbered rows and in odd-numbered columns as well, the first sub-pixels are driven by even-numbered data lines and the second sub-pixels are driven by odd-numbered data lines, among sub-pixel units in both odd-numbered rows and in even-numbered columns as well, the first sub-pixels are driven by odd-numbered data lines and the second sub-pixels are driven by even-numbered data lines, and among sub-pixel units in both even-numbered rows and in even-numbered columns as well, the first sub-pixels are driven by even-numbered data lines and the second sub-pixels are driven by odd-numbered data lines.

* * * * *